US005875379A

United States Patent [19]

Machida et al.

[11] Patent Number: 5,875,379

[45] Date of Patent: Feb. 23, 1999

[54] DEVELOPING DEVICE CAPABLE OF PREVENTING CRACKING OF DEVELOPER DUE TO PRESSING OF A DEVELOPER LAYER CONTROLLING MEMBER

[75] Inventors: Junji Machida, Toyonaka; Syuichi Nakagawa, Suita; Ryuji Inoue, Itami; Yoichi Fujieda, Nishinomiya; Hiroshi Goto, Itami, all of Japan

[73] Assignee: Minolta Co., Ltd., Osaka, Japan

[21] Appl. No.: 915,141

[22] Filed: Aug. 20, 1997

[30] Foreign Application Priority Data

| | | | |
|---|---|---|---|
| Aug. 23, 1996 | [JP] | Japan | 8-241200 |
| Apr. 2, 1997 | [JP] | Japan | 9-084029 |
| Apr. 16, 1997 | [JP] | Japan | 9-098715 |
| May 29, 1997 | [JP] | Japan | 9-139876 |

[51] Int. Cl.[6] ..... G03G 15/08

[52] U.S. Cl. ..... 399/284; 399/274; 399/279; 399/286; 430/107; 430/120

[58] Field of Search ..... 399/222, 252, 399/265, 274, 279, 284, 280; 430/106, 107, 111, 120; 428/323, 335

[56] References Cited

U.S. PATENT DOCUMENTS

| | | | |
|---|---|---|---|
| 4,386,577 | 6/1983 | Hosono et al. . | |
| 4,511,622 | 4/1985 | Seimiya et al. | 428/323 |
| 4,646,677 | 3/1987 | Lounsbury, Jr. et al. . | |
| 4,656,964 | 4/1987 | Kanno et al. . | |
| 4,674,439 | 6/1987 | Sakamoto et al. . | |
| 4,791,882 | 12/1988 | Enoguchi et al. . | |
| 4,827,868 | 5/1989 | Tarumi et al. . | |
| 4,836,136 | 6/1989 | Natsuhara . | |
| 4,847,653 | 7/1989 | Doi et al. . | |
| 4,994,319 | 2/1991 | Nojima et al. | 28/335 |
| 5,034,300 | 7/1991 | Anno et al. . | |
| 5,060,021 | 10/1991 | Yamamoto et al. . | |
| 5,095,341 | 3/1992 | Yoshida et al. . | |
| 5,128,722 | 7/1992 | Natsuhara et al. . | |
| 5,168,312 | 12/1992 | Aoto et al. . | |
| 5,177,323 | 1/1993 | Kohyama | 399/222 |
| 5,206,691 | 4/1993 | Mizuno et al. . | |
| 5,317,370 | 5/1994 | Kohyama et al. | 399/222 |
| 5,324,884 | 6/1994 | Honda et al. | 399/279 |
| 5,338,895 | 8/1994 | Ikegawa et al. . | |
| 5,649,197 | 7/1997 | Fujita | 399/284 X |
| 5,660,963 | 8/1997 | Doujo et al. | 430/107 |

FOREIGN PATENT DOCUMENTS

| | | |
|---|---|---|
| 55-048767 | 4/1980 | Japan . |

*Primary Examiner*—Arthur T. Grimley
*Assistant Examiner*—Sophia S. Chen
*Attorney, Agent, or Firm*—McDermott, Will & Emery

[57] ABSTRACT

A developing device according to the present invention has a developer carrying member for conveying a developer to a developing area opposite to an image carrying member with the developer held on its surface and a controlling member for controlling the amount of the developer conveyed to the developing area upon being pressed against the surface of the developer carrying member, the surface of the developer carrying member and/or the surface of the controlling member pressed against the surface of the developer carrying member being composed of an elastic material having a rubber hardness of 20° to 70° and having elongation of 400 to 1200%.

36 Claims, 3 Drawing Sheets

DEVELOPING DEVICE CAPABLE OF PREVENTING CRACKING OF DEVELOPER DUE TO PRESSING OF A DEVELOPER LAYER CONTROLLING MEMBER

BACKGROUND OF THE INVENTION

1. Field of the Invention

The present invention relates generally to a developing device used for developing a latent image formed on an image carrying member in an image forming apparatus such as a copying machine or a printer. Particularly, it relates to a developing device so adapted as to press a controlling member against the surface of a developer carrying member while conveying a developer to a developing area opposite to an image carrying member with the developer held on the surface of the developer carrying member and control the amount of the developer conveyed to the developing area by the controlling member.

2. Description of the Related Art

In an image forming apparatus such as a copying machine or a printer, various developing devices have been conventionally used for developing a latent image formed on an image carrying member.

As such a developing device, a developing device using a monocomponent developer containing no carrier particles has been known in addition to a developing device using a two-component developer containing carrier particles and toner particles.

In such a developing device using a monocomponent developer, in order that a developer in a suitable amount is stably conveyed to a developing area opposite to an image carrying member by a developer carrying member, one so adapted as to press a controlling member having spring elasticity or rubber elasticity against the surface of a developer carrying member while conveying a developer to a developing area opposite to an image carrying member with the developer held on the surface of the developer carrying member, control the amount of the developer conveyed to the developing area with the developer held on the surface of the developer carrying member by the controlling member, and subject the developer to triboelectric charging has been generally known, as disclosed in Japanese Patent Publication No. 16736/1988.

Examples of the developer carrying member include an elastic roller composed of a rubber material as disclosed in Japanese Patent Publication No. 19749/1987 and one in a sleeve shape composed of a metal or a resin material as disclosed in Japanese Patent Laid-Open No. 226676/1988.

When the controlling member is pressed against the surface of the developer carrying member, to control the amount of the developer conveyed to the developing area as described above, however, a heavy load is applied to the developer by contact pressure of the controlling member, whereby the developer on the surface of the developer carrying member may, in some cases, be cracked, producing fine powder. Particularly in order to form an image at high speed, when the speed at which the developer is conveyed by the developer carrying member is increased, the developer is badly cracked by pressing of the controlling member, producing a lot of fine powder.

When the developer is thus cracked, producing fine powder, the fine powder is gradually increased and is welded on the surface of the developer carrying member, so that a formed image may be made non-uniform in density, for example.

In order to prevent the developer from being cracked by pressing of the controlling member, therefore, a method of weakening contact pressure of the controlling member against the developer carrying member and reducing the load applied to the developer has been considered. When the contact pressure of the controlling member is thus weakened, there are some problems. For example, it is difficult to control the amount of the developer conveyed to the developing area opposite to the image carrying member by the developer carrying member to be a suitable amount, and it is impossible to sufficiently subject the developer to triboelectric changing.

SUMMARY OF THE INVENTION

An object of the present invention is to prevent, in a developing device so adapted as to press a controlling member against the surface of a developer carrying member while conveying a developer to a developing area opposite to an image carrying member with the developer held on the surface of the developer carrying member, to control the amount of the developer conveyed to the developing area, the developer from being cracked by pressing of the controlling member, producing fine powder.

Another object of the present invention is to prevent an image formed upon welding of fine powder of a developer on the surface of a developer carrying member from being made non-uniform in density, for example.

Still another object of the present invention is to stably obtain a good image upon controlling the amount of a developer conveyed to a developing area by the above-mentioned controlling member and subjecting the developer to triboelectric charging by the controlling member more suitably.

A developing device according to the present invention has a developer carrying member for conveying a developer to a developing area opposite to an image carrying member with the developer held on its surface and a controlling member for controlling the amount of the developer conveyed to the developing area upon being pressed against the surface of the developer carrying member, the surface of the developer carrying member and/or the surface of the controlling member pressed against the surface of the developer carrying member being composed of an elastic material having a rubber hardness of 20° to 70° and having elongation of 400 to 1200%. The values of the rubber hardness and the elongation are values measured in accordance with JIS K6301.

If as in the developing device according to the present invention, the elastic material having a rubber hardness of 20° to 70° and having elongation of 400 to 1200% composes the surface of the developer carrying member and/or the surface of the controlling member, the surface of the developer carrying member and the surface of the controlling member pressed against the surface of the developer carrying member are deformed even if the contact pressure of the controlling member is not weakened, so that the load applied to the developer is significantly reduced.

Therefore, the controlling member is pressed against the surface of the developer carrying member by suitable contact pressure, the amount of the developer conveyed to the developing area opposite to the image carrying member by the developer carrying member is controlled to be a suitable amount so that the developer can be sufficiently subjected to triboelectric charging, and the developer is prevented from being cracked by pressing of the controlling member.

As a result, an image formed upon welding of fine powder of the developer on the surface of the developer carrying member is prevented from being made non-uniform in density, for example. Particularly if both the surface of the developer carrying member and the surface of the controlling member are composed of an elastic material having the above-mentioned characteristics, the amount of the developer conveyed to the developing area can be controlled to be a suitable amount upon pressing the controlling member against the surface of the developer carrying member by suitable contact pressure, and the developer can be sufficiently subjected to triboelectric charging even in a case where an image is formed at high speed, the developer is fixed to paper sheets at high speed, or a full-color image is formed on sheets for OHP (Overhead Projector). Further, the cracking of the developer by the controlling member is reduced, so that the formed image is prevented from being made non-uniform in density, for example.

There and other objects, advantages and features of the invention will become apparent from the following description thereof taken in conjunction with the accompanying drawings which illustrate specific embodiment of the invention.

DESCRIPTION OF THE PREFERRED EMBODIMENTS

Figure 1:
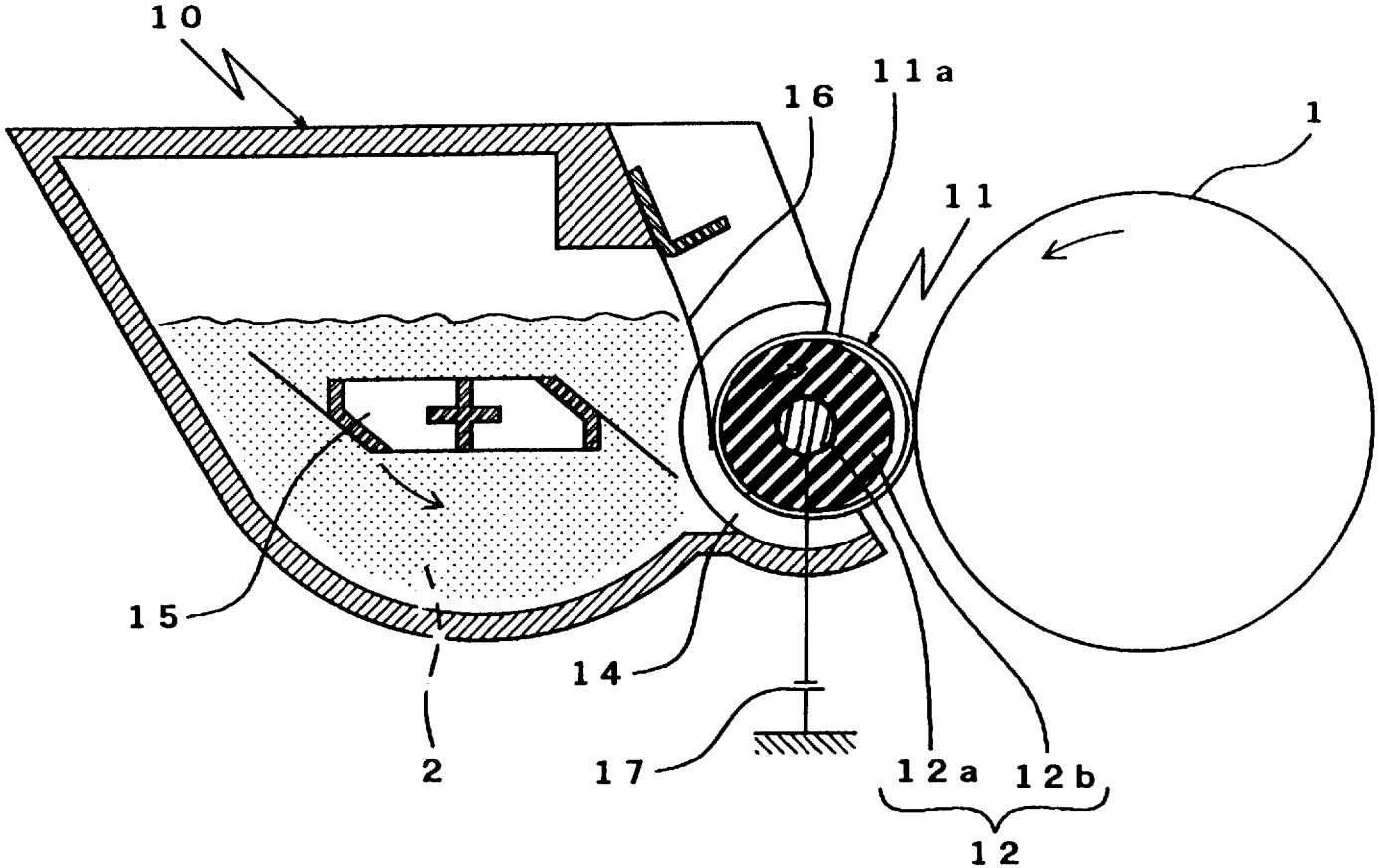
FIG. 1 is a schematic illustration of developing devices according to embodiments 1 and 2 of the present invention.

Preferred embodiments of the present invention will be specifically described.

A developing device according to the present invention has a developer carrying member for conveying a developer to a developing area opposite to an image carrying member with the developer held on its surface as described above, and a controlling member for controlling the amount of the developer conveyed to the developing area upon being pressed against the surface of the developer carrying member, and an elastic material having a rubber hardness of 20° to 70° and having elongation of 400 to 1200% composes the surface of the developer carrying member and/or the surface of the controlling member pressed against the surface of the developer carrying member.

In a case where the rubber hardness of the elastic material is lower than 20°, when the controlling member is pressed against the developer carrying member, to form a toner thin layer on the surface of the developer carrying member, pressure is not easily applied to its contact portion, and the formed toner thin layer is made non-uniform. On the other hand, in a case where the rubber hardness of the elastic material is higher than 70°, when the controlling member is pressed against the developer carrying member, to control the amount of the developer, toner fine powder is produced by the cracking of the developer, so that the toner fine powder is film-formed on the developer carrying member, and image noise is produced. Therefore, it is preferable that the rubber hardness of the elastic material provided on the surface of the developer carrying member is 30° to 70°, and the rubber hardness of the elastic material provided on the surface of the controlling member is 40° to 70°.

If the elongation of the above-mentioned elastic material is smaller than 400%, friction is increased, so that the toner thin layer cannot be uniformly formed at the time of printing resistance. If the elongation thereof is larger than 1200%, pressure is difficult to uniformly apply in forming the toner thin layer in a controlling portion, so that the formed toner thin layer is made non-uniform. Therefore, it is preferable that the elongation of the elastic material provided on the surface of the developer carrying member is 400 to 950%, and the elongation of the elastic material provided on the surface of the controlling member is 550 to 1200%.

Examples of the elastic material provided on the surface of the developer carrying member and the surface of the controlling member include various thermoplastic elastomers such as polystyrene elastomers, polyolefine elastomers, polyurethane elastomers, polyester elastomers, polyvinyl chloride elastomers, polybutadiene elastomers, and polyamide elastomers. Further, examples include vulcanized rubber such as natural rubber, cis-polyisoprene, styrene-butadiene rubber, cis-polybutadiene, chloroprene rubber, butyl rubber, nitrile rubber, ethylene propylene rubber, acrylic rubber, urethane rubber, and silicone rubber.

When a negatively charged developer (negatively charged toner) is used as the above-mentioned developer, it is preferable that a nitrogen-containing elastomer such as a polyurethane elastomer or a polyamide elastomer is contained as an elastic material composing at least one of the surface of the developer carrying member or the surface of the controlling member. In the developer carrying member or the controlling member having a surface layer composed of the elastic material containing the nitrogen-containing elastomer, the chargeability and the charging stability with respect to the negatively charged developer are improved.

In composing the surface of the developer carrying member or the surface of the controlling member by the elastic material containing the nitrogen-containing elastomer, it is preferable that the amount of the nitrogen-containing elastomer in the elastic material is not less than 40% by weight in order to suitably subject the negatively charged developer to triboelectric charging.

In subjecting the developer to triboelectric charging upon pressing the controlling member against the surface of the developer carrying member as described above, a conductivity adding agent, a chargeability adding agent or the like may be mixed with the elastic material composing the surface of the developer carrying member or the surface of the controlling member in order that the developer is suitably subjected to triboelectric charging.

Examples of the conductivity adding agent include carbon black such as Ketchen Black, acetylene black, or furnace black, and fine particles of a metal oxide. It is preferable that they are mixed so that the specific volume resistance value on the surface of the developer carrying member is in the range of $1\times10^{3}\sim10^{15}$ Ω·cm, and preferably in the range of $1\times10^{4}\sim1\times10^{14}$ Ω·cm. The specific volume resistance value is a value measured in accordance with JIS K6911.

Examples of the chargeability adding agent include nigrosine dyes, triphenylmethane dyes, calixarene dyes, quaternary ammonium compounds, and imidazole compounds. They can be used separately or in combination.

In composing the surface of the developer carrying member and the surface of the controlling member by an elastic material having the above-mentioned properties as described above, if the layer of the elastic material is too thin, the load applied to the developer by pressing of the controlling member cannot be sufficiently reduced. Therefore, it is preferable that the thickness of the layer of the elastic material is not less than 100 μm.

Either a contact development system for carrying out development upon bringing the developer held on the developer carrying member into contact with the image carrying member or a non-contact development system for carrying out development upon flying the developer held on the developer carrying member to the image carrying member may be used. A DC electric field or an AC electric field is applied as a developing bias.

On the other hand, as the developer, a known monocomponent developer containing no carrier particles conventionally used is used. Generally, a developer containing a colorant, a charge-controlling agent, a release agent or the like in binder resin is used. A fluidizing agent or the like is added as required.

Also in producing the developer, the developer can be produced by known methods conventionally generally used. Examples include grinding, emulsion polymerization, and suspension polymerization.

If the particle diameter of the developer is too small, the fluidity of the developer is degraded, and the developer is not sufficiently removed. On the other hand, if the particle diameter thereof is too large, the reproducibility of a halftone image, for example, is degraded. Therefore, it is preferable that the volume-average particle diameter thereof is 5 to 12 μm, and preferably 7 to 10 μm. If the number of particles having a particle diameter of not more than 5 μm is too large, the particles are welded on the developer carrying member, so that the developer is not uniformly charged. Therefore, a formed image is fogged, and is made non-uniform in density, for example. Therefore, it is preferable that the content of particles having a particle diameter of not more than 5 μm is not more than 20% by number, and preferably not more than 15% by number of the developer.

As the binder resin used for the developer, known ones conventionally generally used can be used. Examples include polyester resin, styrene resin, styrene-acrylic copolymer resin, epoxy resin, synthetic terpene resin, and synthetic rosin ester resin. They can be used separately or in combination.

It is preferable that examples of the binder resin are one having a number-average molecular weight (Mn) measured by a gel permeation chromatography (GPC) in the range of 1000 to 15000 and preferably 3000 to 12000, one having a softening temperature measured by a flow tester (CFT 500: manufactured by Shimadzu Corporation) in the range of 80° C. to 160° C. and preferably 90° C. to 140° C., and one having a glass transition point measured by a differential scanning calorimeter DSC in the range of 50° C. to 75° C. and preferably 55° C. to 70° C.

As the above-mentioned colorant, known ones conventionally generally used can be used. Examples include carbon black, aniline black, activated carbon, magnetite, benzidine yellow, permanent yellow, naphthol yellow, phthalocyanine blue, fast sky blue, ultramarine blue, and lake red. It is preferable that the amount of the colorant is 2 to 20 parts by weight per 100 parts by weight of the above-mentioned binder resin.

As the above-mentioned charge-controlling agent, known ones conventionally generally used can be also used. Examples include organic metal complexes such as monoazo metal complexes, aromatic hydroxy-carboxylic acid type metal complexes, aromatic dicarboxylic acid metal complexes, and chelate compounds. It is preferable that the amount of the charge-controlling agent is 1 to 10 parts by weight per 100 parts by weight of the above-mentioned binder resin.

As the above-mentioned release agent, known ones conventionally generally used can be also used. Examples include low molecular weight polyethylene, low molecular weight polypropylene, low molecular weight polyethylene having acid groups, low molecular weight polypropylene having acid groups, microcrystalline wax, paraffin wax, carnauba wax, and SASOL WAX (made by SASOL Chemical Industry). They can be used separately or in combination. It is preferable that the amount of the release agent is 1 to 8 parts by weight per 100 parts by weight of the above-mentioned binder resin.

As the above-mentioned fluidizing agent, known ones conventionally generally used can be also used. Examples include inorganic fine particles of silica, titanium oxide, and aluminum oxide, and resinous fine particles of acrylic resin, styrene resin, silicone resin, and fluoroplastics. Particularly, it is preferable to use a fluidizing agent which is made hydrophobic by a silane coupling agent, a titanium coupling agent, silicone oil, or the like. The amount of the fluidizing agent added is 0.1 to 3 parts by weight per 100 parts by weight of the developing agent.

When the developer is fixed to paper sheets at high speed, a developer having low-temperature fixing properties must be used. When a full-color image is formed on sheets for OHP, a developer having light transmission must be used. Examples of the developer having low-temperature fixing properties or the developer having light transmission include developers having a grindability index K of 0.7 to 2.0. When the developer having such a grindability index is used, the developer is easily cracked. Therefore, the surface of the developer carrying member and the surface of the controlling member must be composed of an elastic material having a rubber hardness of 20° to 70° and having elongation of 400 to 1200%.

As the binder resin used for the developer having light transmission, it is preferable to use binder resin having a number-average molecular weight of 2000 to 9000 and preferably 2500 to 6000, having a glass transition point of 55° to 75° C. and preferably 58 to 70° C., and having a softening point of 85° to 135° C. and preferably 90° to 120° C.

The grindability index K is found by the following equation, letting $W_0$[W] be the value of load power applied to a motor of a grinding rotor in a case where the speed of rotation of the grinding rotor is set to 9300 rpm, and the total air flow is set 7.0 $Nm^3$/min upon bringing a Cryptron grinding machine (KTM-1: manufactured by Kawasaki Heavy Industries, Ltd.) into a closed state, $D_0$[μm] be the average particle diameter of coarse powder obtained by pulverization using a feather mill, F[kg/hr] be the amount of the coarse powder supplied to the grinding machine, $W_1$[W] be the value of load power applied to the motor of the grinding rotor in pulverizing the coarse powder, and $D_1$[μm] be the average particle diameter of the coarse powder after the pulverization. The average particle diameter $D_1$ of the coarse powder after the pulverization is measured by Multisizer II Type of Coltar Counter manufactured by Coltar K. K:

$$K=(W_1-W_0)/F\times D_0\cdot D_1/(D_0-D_1)$$

where it is assumed that $D_0$-$D_1$=$D_0$ in a case where $D_0$>>$D_1$, the grindability index is found by the following equation:

$$K=(W_1-W_0)\times D_1/F$$

Specific embodiments of the present invention will be described on the basis of accompanying drawings.

Embodiment 1

In a developing device according to the present embodiment 1, a driving roller 12 having a rubber roller 12*b* having conductive properties provided on the outer periphery of a metal shaft 12*a* is provided in the main body 10 of the device so as to be opposite to an image carrying member 1, and a developer carrying member 11 in a sleeve shape whose diameter is made larger than that of the driving roller 12 is provided on the outer periphery of the driving roller 12.

Figure 2:
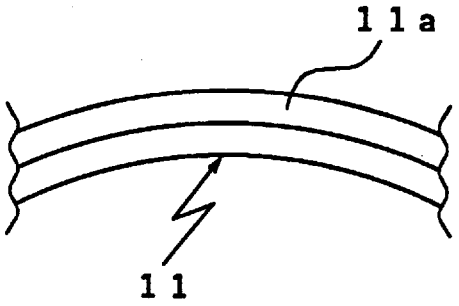
FIG. 2 is a partial illustration showing a state where a surface layer is formed on the surface of a developer carrying member in the developing device according to the embodiment 1 of the present invention.

In the developing device according to the embodiment 1, an example of the developer carrying member 11 is one formed of nylon resin in a sleeve shape, and a surface layer 11*a* composed of an elastic material whose rubber hardness (A type) and elongation which are measured in accordance with JIS K6301 are respectively 20° to 70° and 400 to 1200% is provided on the surface of the developer carrying member 11, as shown in FIG. 2.

In the main body 10 on the opposite side of a developing area where the developer carrying member 11 is opposite to the image carrying member 1, both sides of the developer carrying member 11 are pressed against an outer peripheral surface of the driving roller 12 by a guide member 14, so that the developer carrying member 11 is driven as the driving roller 12 is rotated, and the developer carrying member 11 is brought into soft contact with the surface of the image carrying member 1 upon protruding toward the image carrying member 1 from the driving roller 12 in the developing area opposite to the image carrying member 1.

A developer 2 is contained in the main body 10 of the device, and an agitator 15 is provided therein. The agitator 15 is rotated, to supply the developer 2 contained in the main body 10 to the surface of the developer carrying member 11.

While the developer 2 supplied to the surface of the developer carrying member 11 is conveyed to the developing area opposite to the image carrying member 1 by the developer carrying member 11 as the driving roller 12 is rotated, a controlling member 16 provided in the main body 10 is pressed against the surface of the developer carrying member 11, to control the amount of the developer 2 conveyed to the developing area by the developer carrying member 11 as well as to subject the developer 2 on the surface of the developer carrying member 11 to triboelectric charging.

In the developing device in the present embodiment, the surface layer 11*a* composed of an elastic material having a rubber hardness of 20° to 70° and having elongation of 400 to 1200% is provided on the surface of the developer carrying member 11 as described above. When the developer 2 conveyed by the developer carrying member 11 is controlled by the controlling member 16 as described above, therefore, the load exerted on the developer 2 is reduced by the surface layer 11*a*, so that the developer 2 is prevented from being cracked by pressing of the controlling member 16.

The amount of conveyance is thus controlled by the controlling member 16, to convey the developer 2 subjected to triboelectric charging to the developing area opposite to the image carrying member 1 by the developer carrying member 11, a developing bias voltage is applied from the power supply 17 through the driving roller 12. In the developing area where the developer carrying member 11 is brought into soft contact with the surface of the image carrying member 1 as described above, the developer 2 held by the developer carrying member 11 is supplied to an electrostatic latent image formed on the image carrying member 1 to perform development.

Embodiment 2

Figure 3:
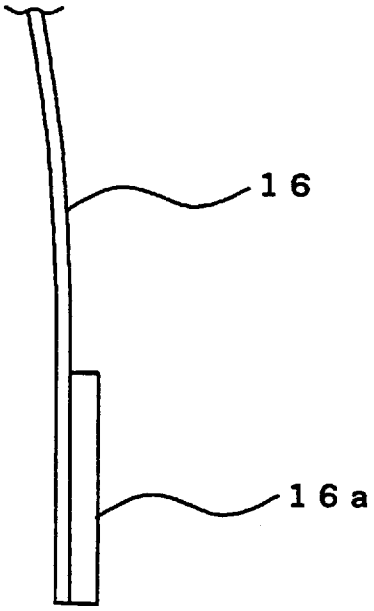
FIG. 3 is a partial illustration showing a state where a surface layer is formed on the surface of a controlling member in the developing device according to the embodiment 2 of the present invention.

A developing device according to the present embodiment is also constructed similarly to the developing device according to the embodiment 1 shown in FIG. 1. In the developing device in the present embodiment, a surface layer 16*a* composed of the same elastic material as that in the embodiment 1 is provided on a part of the surface of a controlling member 16 pressed against the surface of a developer carrying member 11, as shown in FIG. 3, in place of providing the surface layer 11*a* on the surface of the developer carrying member 11 in a sleeve shape.

In the developing device according to the present embodiment, when the controlling member 16 provided with the surface layer 16*a* is pressed against the surface of the developer carrying member 11 as described above, to control a developer 2 supplied to the surface of the developer carrying member 11, the load exerted on the developer 2 by the surface layer 16*a* provided on the surface of the controlling member 16 is reduced, so that the developer 2 is prevented from being cracked by pressing of the controlling member 16 in the same manner as that in the above-mentioned embodiment 1.

Embodiment 3

In a developing device according to the present embodiment 3, only a developer carrying member 11 is changed from that in the developing device according to the embodiment 1 shown in FIG. 1. In the embodiment 3, a developing roller 11 having a roller 11*c* provided on the outer periphery of a rotating shaft 11*b* is used as the developer carrying member 11, and a surface layer 11*a* composed of an elastic material having a rubber hardness of 20° to 70° and having elongation of 400 to 1200% is provided as described above on the surface of the developing roller 11, as shown in FIG. 4.

Also in the developing device according to the embodiment 3, when a controlling member 16 is pressed against the surface of the developing roller 11 provided with the surface layer 11*a* as described above, to control a developer 2 supplied to the surface of the developing roller 11, the load exerted on the developer 2 by the surface layer 11*a* provided on the surface of the developing roller 11 is reduced, so that the developer 2 is prevented from being cracked by pressing of the controlling member 16 in the same manner as that in the above-mentioned embodiments 1 and 2.

Embodiment 4

Figure 4:
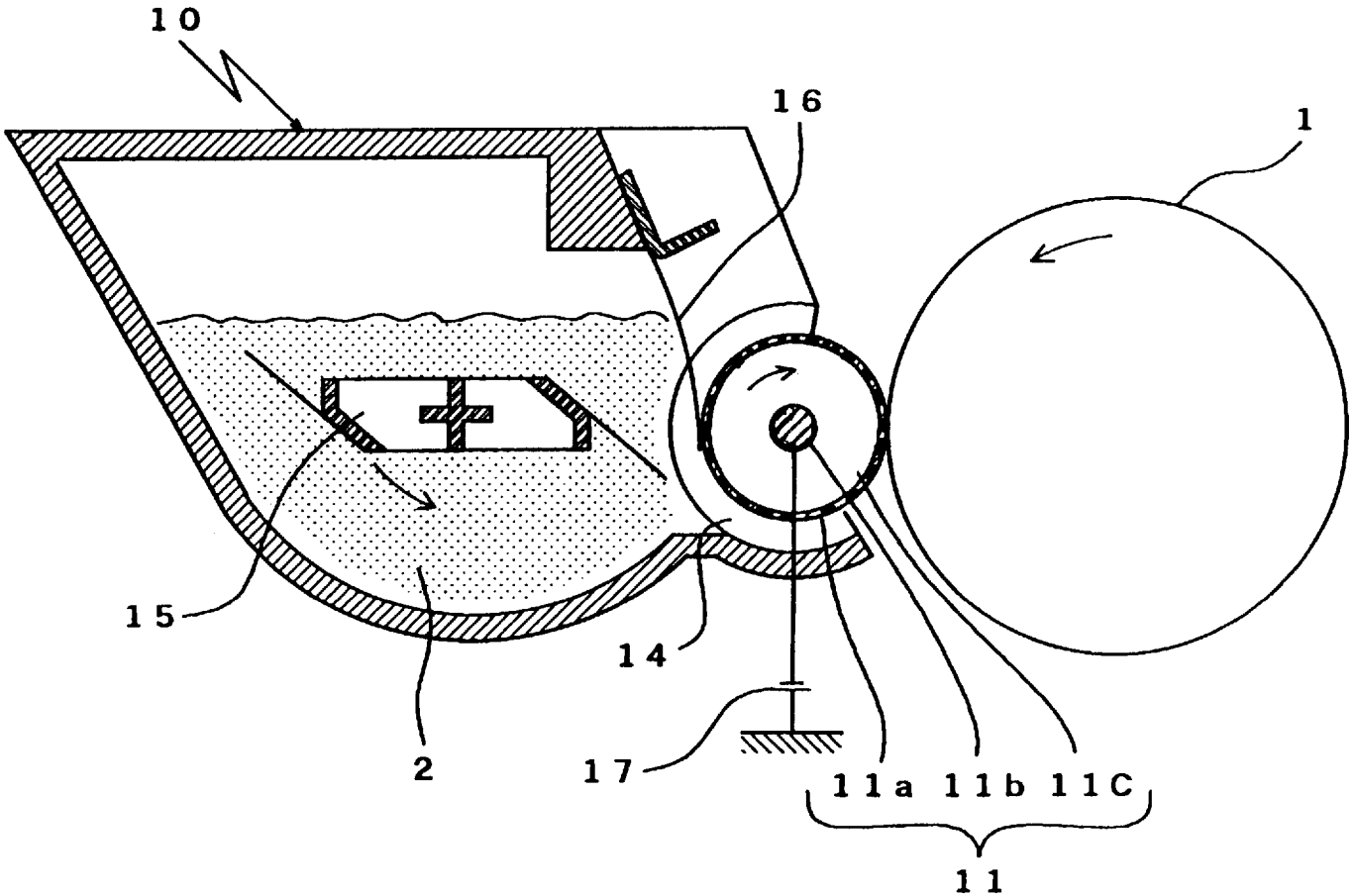
FIG. 4 is a schematic illustration showing developing devices according to embodiments 3 and 4 of the present invention.

A developing device according to the present embodiment 4 is also constructed similarly to the developing device in the above-mentioned embodiment 3 shown in FIG. 4. In the developing device in the present embodiment, surface layers 11*a* and 16*a* composed of an elastic material having a rubber hardness of 20° to 70° and having elongation of 400 to 1200% are respectively provided in parts of the surface of a developing roller 11 and the surface of a controlling member 16 pressed against the surface of the developing roller 11, as shown in FIGS. 2 and 3.

Also in the developing device according to the embodiment 4, when the controlling member 16 provided with the surface layer 16*a* is pressed against the surface of the developing roller 11 provided with the surface layer 11*a* as describe above, to control a developer 2 supplied to the surface of the developing roller 11, the load exerted on the developer 2 is further reduced, as compared with that in the embodiment 3, by the respective surface layers 11*a* and 16*a* provided on the surface of the developing roller 11 and the surface of the controlling member 16. When the speed at which the developer 2 is conveyed by the developing roller 11 is increased in order to form an image at high speed, the developer 2 is prevented from being cracked by pressing of the controlling member 16.

Experimental Example 1

As in the developing device shown in the above-mentioned embodiment 1, the surface layer 11*a* composed of an elastic material was provided on the surface of the developer carrying member 11 formed of nylon resin in a sleeve shape, to change the type of the surface layer 11*a*. Further, an SUS plate was used as the controlling member 16.

On the other hand, the following toner A was used as the developer 2.

In producing the toner A, 100 parts by weight of polyester resin (Tafton NE-1110: made by Kao K. K.), 8 parts by weight of carbon black which is a colorant (Mogul L: made by Cabot K. K.), 3 parts by weight of a charge-controlling agent (Bontron S-34: made by Orient Kagaku K. K.), and 2.5 parts by weight of a release agent (Biscole TS-200: made by Sanyo Kasei Kogyo K. K.) were mixed at a speed of rotation of 2800 rpm by Henschel Mixer for three minutes, after which a mixture obtained was kneaded using a biaxial kneading extruder, and the kneaded mixture obtained was cooled. Thereafter, the kneaded mixture was coarsely pulverized, was further finely pulverized by a ultrasonic jet grinding machine (manufactured by Nippon Pneumatic K. K.), and was then classified by Elbow Jet (manufactured by Matusaka Boeki K. K.), to obtain toner particles having a volume-average particle diameter of 8.3 $\mu$m and containing 14.1% by number particles having a particle diameter of not more than 5 $\mu$m. Hydrophobic silica (Cabozil TS-500: made by Cabot K. K.) was added in the ratio of 0.8% by weight to the toner particles. They were mixed at a speed of rotation of 2500 rpm by Henschel Mixer for 90 seconds, to produce negatively charged toner A. When coarse powder obtained by the coarse pulverization was finely pulverized using a Cryptron grinding machine, and the grindability index K thereof was measured. The result was 1.6

EXAMPLE 1

50 parts by weight of a thermoplastic butadiene elastomer having a rubber hardness of 95° and having elongation of 670%, 150 parts by weight of a thermoplastic styrene elastomer having a rubber hardness of 37° and having elongation of 1200%, 10 parts by weight of a charge-controlling agent, and 2 parts by weight of Ketchen Black were mixed and kneaded, after which a kneaded mixture obtained was dissolved in toluene, and the surface of the developer carrying member 11 was dip coated with a solution obtained, to form a surface layer 11*a* having a thickness of 100 $\mu$m. With respect to the surface layer 11*a*, the rubber hardness and the elongation thereof were measured by a test method shown in JIS K6301, and the specific volume resistance value thereof was measured by a test method shown in JIS K6911. The results were shown in the following Table 1.

EXAMPLE 2

200 parts by weight of a thermoplastic styrene elastomer having a rubber hardness of 15° and having elongation of 930%, 10 parts by weight of a charge-controlling agent, and 20 parts by weight of acetylene black were mixed and kneaded, after which a kneaded mixture obtained was dissolved in toluene, and the surface of the developer carrying member 11 was dip coated with a solution obtained, to form a surface layer 11*a* having a thickness of 100 $\mu$m in the same manner as that in the above-mentioned example 1. With respect to the surface layer 11*a*, the rubber hardness, the elongation, and the specific volume resistance value thereof were measured. The results were shown in the following Table 1.

comparative Example 1

200 parts by weight of a thermoplastic styrene elastomer having a rubber hardness of 61° and having elongation of 1060%, 10 parts by weight of a charge-controlling agent, and 20 parts by weight of acetylene black were mixed and kneaded, after which a kneaded mixture obtained was dissolved in toluene, and the surface of the developer carrying member 11 was dip coated with a solution obtained, to form a surface layer 11*a* having a thickness of 120 $\mu$m in the same. manner as that in the above-mentioned example 1. With respect to the surface layer 11*a*, the rubber hardness, the elongation, and the specific volume resistance value thereof were measured. The results were shown in the following Table 1.

Experimental Example 2

In the experimental example, an example of the above-mentioned controlling member 16 was one composed of an SUS plate, the surface layer 16*a* composed of an elastic material was provided on a part of the surface of the controlling member 16, to change the type of the surface layer 16*a*, as in the above-mentioned developing device according to the embodiment 2. As the developing agent 2, the above-mentioned toner A was used.

EXAMPLE 3

200 parts by weight of a thermoplastic olefin elastomer having a rubber hardness of 55° and having elongation of 730%, 15 parts by weight of a charge-controlling agent, and 2 parts by weight of Ketchen Black were mixed and kneaded, after which a kneaded mixture obtained was integrally press-molded on the surface of the controlling member 16, to form a surface layer 16*a* having a thickness of 500 $\mu$m. With respect to the surface layer 16*a*, the rubber hardness, the elongation, and the specific volume resistance value thereof were measured. The results were shown in the following Table 1.

EXAMPLE 4

200 parts by weight of a thermoplastic styrene elastomer having a rubber hardness of 15° and having elongation of 930%, 10 parts by weight of a charge-controlling agent, and 20 parts by weight of acetylene black were mixed and kneaded, after which a kneaded mixture obtained was dissolved in toluene, and the surface of the controlling member 16 was dip coated with a solution obtained, to form a surface layer 11*a* having a thickness of 50 $\mu$m. With respect to the surface layer 16*a*, the rubber hardness, the elongation, and the specific volume resistance value thereof were measured. The results were shown in the following Table 1.

Comparative Example 2

Silicone rubber was integrally press-molded on the surface of the controlling member 16, to form a surface layer 16*a* having a thickness of 1 mm. With respect to the surface layer 16*a*, the rubber hardness, the elongation, and the specific volume resistance value thereof were measured. The results were shown in the following Table 1.

A cracking test of the developer was carried out, and non-uniformity in density after a printing resistance test of 10,000 sheets was evaluated using the developer carrying member 11 and the controlling member 16 described in the examples 1 to 4 and the comparative examples 1 and 2.

Cracking Test 1 of Developer

The developer 2 was set on the developer carrying member 11, the controlling member 16 was pressed against the developer carrying member 11 at a line pressure of 5.5 g/mm, to control the developer 2, and the ratio (number %) of fine power components having a particle diameter of not more than 5 μm was examined, respectively, at the initial stages and after rotating the developer carrying member 11 200 times. The results were shown in Table 1.

Printing Resistance Test 1

An image was formed on 10,000 sheets at a system speed of 60 mm/s, to evaluate the non-uniformity in density of the image after a printing resistance test of the 10,000 sheets. A case where the image was uniform in density and was good was indicated by ○, a case where the image was slightly non-uniform in density, which practically presents no problem was indicated by Δ, and a case where the image was highly non-uniform in density, which presents a problem was indicated by X.

developing devices in the embodiments 1 to 3 in which the thicknesses of the surface layers 11*a* and 16*a* were not less than 100 μm.

Experimental Example 3

In the experimental example, an example of the above-mentioned developing roller 11 was a roller 11*c* made of a metal, an example of the controlling member 16 was one composed of an SUS plate, and an example of the developer 2 was the above-mentioned toner A.

As in the developing device shown in the above-mentioned embodiment 4, the surface layers 11*a* and 16*a* composed of an elastic material were respectively provided on parts of the surface of the developing roller 11 and the surface of the controlling member 16, to change the type of the surface layers 11*a* and 16*a*.

EXAMPLE 5

100 parts by weight of unvulcanized rubber composed of ethylene—propylene—diene—methylene rubber (EPDM), 7 parts by weight of carbon black (Ketchen Black), 4 parts by weight of a positive charge-controlling agent (P-53: made by Orient Kagaku K. K.), 3 parts by weight of sulfur which is a vulcanizing agent, and 0.5 parts by weight of cyclohexyl benzothiazole sulfen amide which is a vulcanization accelerator were kneaded and dispersed at a temperature of 125° C. by three rolls, and the surface of the developing roller 11 was coated with a kneaded mixture obtained, after which the kneaded mixture was vulcanized in a dryer having a temperature of 150° C. for thirty minutes, and was then cooled,

TABLE 1

| | Surface layer | | | | cracking test (number %) | | printing resistance test |
|---|---|---|---|---|---|---|---|
| | hardness (°) | elongation % | thickness (μm) | resistance value (Ω cm) | initial stages | after rotating 200 times | non-uniformity in density |
| example 1 | 54 | 1020 | 100 | $6.6 \times 10^{13}$ | 9.8 | 14.2 | ○ |
| example 2 | 29 | 710 | 100 | $3.4 \times 10^{10}$ | 10.0 | 11.5 | ○ |
| comparative example 1 | 77 | 850 | 120 | $3.6 \times 10^{10}$ | 9.8 | 25.8 | X |
| example 3 | 68 | 590 | 500 | $7.9 \times 10^{13}$ | 9.9 | 13.3 | ○ |
| example 4 | 29 | 710 | 50 | $4.1 \times 10^{10}$ | 10.1 | 18.0 | Δ |
| comparative example 2 | 50 | 290 | 1000 | $6.2 \times 10^{14}$ | 10.2 | 20.1 | X |

As apparent from the results, in providing the surface layers 11*a* and 16*a* composed of an elastic material on the surface of the developer carrying member 11 and the surface of the controlling member 16, in the developing device in each of the examples in which the surface layers 11*a* and 16*a* having a rubber hardness of 20° to 70° and having elongation of 400 to 1200% were provided, the increase of the fine power components in the cracking test was slighter, and the occurrence of the non-uniformity in density of the formed image was restrained, as compared with the developing device in each of the comparative examples in which the surface layers 11*a* and 16*a* which do not satisfy the conditions of the present invention were provided, so that a good image was stably obtained.

When the developing devices in the above-mentioned examples 1 to 4 were compared with each other, the production of the fine powder and the occurrence of the non-uniformity in density were further restrained in the and the surface thereof was polished, to form the surface layer 11*a*. With respect to the surface layer 11*a*, the rubber hardness, the elongation, and the specific volume resistance value thereof were measured. The results were shown in the following Table 2.

On the other hand, 100 parts by weight of a thermoplastic styrene elastomer, 15 parts by weight of carbon black (Ketchen Black), and 3 parts by weight of a positive charge-controlling agent (Rubenal A-1: made by Arkawa Kagaku K. K.) were kneaded and dispersed by three rolls, to form an elastic sheet having a thickness of 1 mm. With respect to the elastic sheet, the rubber hardness, the elongation, and the specific volume resistance value thereof were measured. The results were shown in the following Table 2.

The elastic sheet adhered to the surface of the controlling member 16 upon being cut to widths of 5 mm, to provide the surface layer 16*a* on the surface of the controlling member 16.

EXAMPLE 6

50 parts by weight of a polyamide elastomer, 50 parts by weight of a thermoplastic styrene elastomer, and 7 parts by weight of carbon black (Furnace Black) were kneaded and dispersed at a temperature of 190° C. by three rolls, and the surface of the developing roller 11 was coated with a kneaded mixture obtained, after which the surface was polished, to form the surface layer 11*a*. with respect to the surface layer 11*a*, the rubber hardness, the elongation, and the specific volume resistance value thereof were measured. The results were shown in the following Table 2.

On the other hand, 100 parts by weight of a thermoplastic 1,2-butadiene elastomer, 5 parts by weight of carbon black (Ketchen Black), and 2 parts by weight of a positive charge-controlling agent composed of a nigrosine dye were kneaded and dispersed by three rolls, to form an elastic sheet having a thickness of 1 mm. With respect to the elastic sheet, the rubber hardness, the elongation, and the specific volume resistance value thereof were measured. The results were shown in the following Table 2.

The elastic sheet adhered to the surface of the controlling member 16 upon being cut to widths of 5 mm, to provide the surface layer 16*a* on the surface of the controlling member 16 in the same manner as that in the above-mentioned example 5.

EXAMPLE 7

The surface layer 11*a* was formed on the surface of the developing roller 11 in the same manner as that in the above-mentioned example 5 after 100 parts by weight of unvulcanized ether type urethane rubber, 15 parts by weight of carbon black (Ketchen Black), 3 parts by weight of sulfur which is a vulcanizing agent, and 0.5 parts by weight of cyclohexyl benzothiazole sulfen amide which is a vulcanization accelerator were used. With respect to the surface layer 11*a*, the rubber hardness, the elongation, and the specific volume resistance value thereof were measured. The results were shown in the following Table 2.

On the other hand, 100 parts by weight of a thermoplastic olefin elastomer, 5 parts by weight of carbon black (Ketchen Black), and 4 parts by weight of an imidazole compound which is a positive charge-controlling agent (RLZ-1001: Shikoku Kasei Kogyo K. K.) were kneaded and dispersed by three rolls, to form an elastic sheet having a thickness of 1 mm. With respect to the elastic sheet, the rubber hardness, the elongation, and the specific volume resistance value thereof were measured. The results were shown in the following Table 2.

The elastic sheet adhered to the surface of the controlling member 16 upon being cut to widths of 5 mm, to provide the surface layer 16*a* on the surface of the controlling member 16 in the same manner as that in the above-mentioned example 5.

EXAMPLE 8

The surface layer 11*a* was formed on the surface of the developing roller 11 in the same manner as that in the above-mentioned example 5 after 100 parts by weight of a thermoplastic olefin elastomer, 45 parts by weight of carbon black (Furnace Black), and 4 parts by weight of an imidazole compound which is a positive charge-controlling agent (PLZ-1001: made by Shikoku Kasei Kogyo K. K.). With respect to the surface layer 11*a*, the rubber hardness, the elongation, and the specific volume resistance value thereof were measured. The results were shown in the following Table 2.

On the other hand, the surface layer 16*a* was provided on the surface of the controlling member 16 in the same manner as that in the example 6.

EXAMPLE 9

The surface layer 11*a* was formed on the surface of the developing roller 11 in the same manner as that in the above-mentioned example 6 after 100 parts by weight of a thermoplastic olefin elastomer, 5 parts by weight of carbon black (Acetylene Black), and 2 parts by weight of a positive charge-controlling agent (Rubenal A-1: made by Arakawa Kagaku K. K.) were used. With respect to the surface layer 11*a*, the rubber hardness, the elongation, and the specific volume resistance value thereof were measured. The results were shown in the following Table 2.

On the other hand, the surface layer 16*a* was provided on the surface of the controlling member 16 in the same manner as that in the example 5.

Comparative Example 3

The surface layer 11*a* was provided on the surface of the developing roller 11 in the same manner as that in the example 9.

On the other hand, 100 parts by weight of a thermoplastic styrene elastomer and 2 parts by weight of carbon black (Furnace Black) were kneaded and dispersed by three rolls, to form an elastic sheet having a thickness of 1 mm. With respect to the elastic sheet, the rubber hardness, the elongation, and the specific volume resistance value thereof were measured. The results were shown in the following Table 2.

The elastic sheet adhered to the surface of the controlling member 16 upon being cut to widths of 5 mm, to provide the surface layer 16*a* on the surface of the controlling member 16.

Comparative Example 4

The surface layer 11*a* was provided on the surface of the developing roller 11 in the same manner as that in the example 9.

On the other hand, 100 parts by weight of a thermoplastic polyamide elastomer and 5 parts by weight of carbon black (Furnace Black) were kneaded and dispersed by three rolls, to obtain an elastic sheet having a thickness of 1 mm. With respect to the elastic sheet, the rubber hardness, the elongation, and the specific volume resistance value thereof were measured. The results were shown in the following Table 2.

The elastic sheet adhered to the surface of the controlling member 16 upon being cut to widths of 5 mm, to provide the surface layer 16*a* having the above-mentioned rubber hardness and elongation on the surface of the controlling member 16 in the same manner as that in the above-mentioned example 5.

A cracking test of the developer was carried out, and non-uniformity in density after a printing resistance test of 10,000 sheets was evaluated using the developer carrying member 11 and the controlling member 16 shown in the examples 5 to 9 and the comparative examples 3 and 4.

Cracking Test 2 of Developer

The ratio (number %) of fine power components having a particle diameter of not more than 5 $\mu$m in the number distribution was examined in the same manner as that in the cracking test 1 of the developer except that the developer carrying member 11 was rotated 250 times. The results were shown in the following Table 2.

Printing Resistance Test 2

The non-uniformity in density of an image after a printing resistance test of 10,000 sheets was evaluated in the same manner as that in the printing resistance test 1 except that the image was formed at two system speeds of 60 mm/s and 150 mm/s.

TABLE 2

| | Surface layer | | | | | | | | | |
|---|---|---|---|---|---|---|---|---|---|---|
| | developing roller | | | controlling member | | | cracking test (number %) | | printing resistance test | |
| | hardness | elongation | resistance value | hardness | elongation | resistance value | initial | after rotating | non-uniformity in density | |
| | (°) | % | (Ω · cm) | (°) | % | (Ω · cm) | stages | 250 times | 60 mm/s | 150 mm/s |
| example 5 | 62 | 658 | $2.6 \times 10^7$ | 52 | 826 | $7.4 \times 10^7$ | 10.5 | 12.8 | ○ | ○ |
| exanple 6 | 66 | 486 | $4.1 \times 10^6$ | 69 | 760 | $2.1 \times 10^9$ | 11.6 | 14.5 | ○ | ○ |
| example 7 | 61 | 420 | $7.3 \times 10^5$ | 48 | 774 | $6.9 \times 10^8$ | 9.9 | 11.2 | ○ | ○ |
| exanple 8 | 53 | 800 | $3.6 \times 10^4$ | 69 | 760 | $7.4 \times 10^7$ | 12.3 | 13.9 | ○ | ○ |
| exanple 9 | 97 | 430 | $3.9 \times 10^{10}$ | 52 | 820 | $7.4 \times 10^7$ | 10.4 | 19.0 | ○ | Δ |
| comparative example 3 | 97 | 430 | $3.9 \times 10^{10}$ | 18 | 890 | $7.0 \times 10^{11}$ | 11.2 | 14.1 | X | X |
| comparative example 4 | 97 | 430 | $3.9 \times 10^{10}$ | 93 | 250 | $2.8 \times 10^8$ | 12.8 | 28.7 | X | X |

As apparent from the results, in the developing device in each of the examples 5 to 9 in which in respectively providing the surface layers 11*a* and 16*a* composed of an elastic material on the surface of the developer carrying member 11 and the surface of the controlling member 16, the surface layers 11*a* and 16*a* having a rubber hardness of 20° to 70° and having elongation of 400 to 1200% were provided on at least one of the surface of the developer carrying member 11 and the surface of the controlling member 16, the increase of the fine power components in the cracking test was slight, and the occurrence of the non-uniformity in density of the formed image was restrained, so that a good image was stably obtained.

On the other hand, in the developing device in the comparative example 3 in which the rubber hardness on the surface layer 11*a* of the developing roller 11 was as high as 97°, while the rubber hardness on the surface 16*a* of the controlling member 16 was as low as 18°, the increase of the fine power components in the cracking test was slight. Since the hardness of the controlling member 16 was low, however, the developer 2 conveyed by the developer carrying member 11 was not uniformly controlled, so that the formed image was made non-uniform in density. In the developing device in the comparative example 4 in which the rubber hardness on the surface layer 11*a* of the developing roller 11 and the surface layer 16*a* of the controlling member 16 was high, the increase of the fine power components in the cracking test was significant, so that the formed image was made non-uniform in density.

When the developing devices in the above-mentioned examples 5 to 9 were compared with each other, in the developing device in each of the examples 5 to 8 in which the surface layers 11*a* and 16*a* satisfying the conditions of the present invention were provided on both the surface of the developer carrying member 11 and the surface of the controlling member 16, the increase of the fine power components in the cracking test was further slighter, as compared with that in the example 9 in which the surface layer 16*a* satisfying the conditions of the present invention was provided on only the surface of the controlling member 16. Even when an image was formed at a high system speed of 150 mm/s, the occurrence of the non uniformity in density of the formed image was also restrained, so that a good image was stably obtained.

Experimental Example 4

In the experimental example, an example of the above mentioned developing roller 11 was a roller 11*c* made of a metal, an example of the controlling member 16 was one composed of an SUS plate, and an example of the developer 2 was the above-mentioned toner A, As in the developing device shown in the above-mentioned embodiment 3, the surface layer 11*a* composed of an elastic material was provided on the surface of the developing roller 11, to change the type of the surface layer 11*a*.

Examples 10 to 14 and comparative Examples 5 and 6

In the examples and the comparative examples, in providing the surface layer 11*a* on the surface of the above-mentioned developer carrying member 11, examples of the elastic material were a nitrogen-containing elastomer composed of polyamide having a rubber hardness of 93° and having elongation of 300%, and a styrene elastomer having a rubber hardness of 37° and having elongation of 1200%.

The nitrogen-containing elastomer composed of polyamide and the styrene elastomer were used in the weight ratio shown in the following Table 3, a conductivity adding agent (Ketchen Black) was mixed in the ratio of 3 parts by weight with 100 parts by weight of the respective elastic materials, mixtures obtained were kneaded at a temperature of 190° C. by three rolls for 15 minutes without adding a charge-controlling agent, and the surface of the developer carrying member 11 was coated with the kneaded mixtures, to form respective surface layers 11*a* having a thickness of approximately 100 μm.

With respect to each of the surface layers 11*a* thus formed, the rubber hardness, the elongation, and the specific volume resistance value thereof were measured. The results were shown in the following Table 3.

Non-uniformity in density after a printing resistance test of 10,000 sheets was examined, and a state where an image was fogged was examined using each of the developing devices in the examples 10 to 14 and the comparative examples 5 and 6 using the respective developer carrying members 11.

Printing Resistance Test 3

The non-uniformity in density of an image after a printing resistance test of 10,000 sheets was evaluated in the same manner as that in the printing resistance test 1 except that the image was formed at a system speed of 150 mm/s.

Fogging

An image was formed under a high temperature of 30° C. and a high humidity of 85%, and a state where the developer 2 adheres to a non-image portion of the formed image and a state where the developer 2 adheres to a non-image portion of the image carrying member 1 were examined. A case where the image was not fogged was indicated by ○, a case where the image was fogged, which practically presents no problem was indicated by Δ, and a case where the image was greatly fogged, which presents a problem was indicated by x.

developer carrying member 11 containing not less than 40% by weight the nitrogen-containing elastomer in the elastic material composing the surface layer 11*a*, the image was further hardly fogged. It was possible to prevent the image from being fogged by adding the positive charge-controlling agent to the surface layer 11*a* of the developer carrying member 11.

Although in the above-mentioned examples, description was made of only a case where the nitrogen-containing elastomer composed of polyamide was contained in the elastic material composing the surface layer 11*a* of the developer carrying member 11, approximately the same effect is also obtained in a case where the same nitrogen-containing elastomer is contained in the elastic material composing the surface layer 16*a* of the controlling member 16 pressed against the surface of the developer carrying member 11. Further, when the nitrogen-containing elastomer is contained in each of the elastic materials composing the surface layer 11*a* of the developer carrying member 11 and the surface layer 16*a* of the controlling member 16, the developer 2 is subjected to triboelectric charging more easily.

TABLE 3

| | Surface layer | | | | printing resistance test | fogging | |
|---|---|---|---|---|---|---|---|
| | elastic material (weight ratio) polyamide: styrene | hardness (°) | elongation % | resistance value (Ω · cm) | non-uniformity in density | image | image carring member |
| example 10 | 60:40 | 68 | 790 | $1.8 \times 10^{9}$ | ○ | ○ | ○ |
| example 11 | 50:50 | 60 | 920 | $7.9 \times 10^{9}$ | ○ | ○ | ○ |
| example 12 | 40:60 | 55 | 1010 | $2.3 \times 10^{10}$ | ○ | Δ | Δ |
| example 13 | 30:70 | 50 | 1150 | $5.9 \times 10^{11}$ | ○ | Δ | X |
| example 14 | 0:100 | 37 | 1200 | $3.6 \times 10^{9}$ | ○ | X | X |
| comparative example 5 | 80:20 | 83 | 480 | $8.3 \times 10^{8}$ | X | ○ | ○ |
| comparative example 6 | 70:30 | 75 | 650 | $4.3 \times 10^{15}$ | X | ○ | ○ |

As a result, in each of the developing devices in the examples 10 to 14 in which the surface layer 11*a* having a rubber hardness of 20° to 70° and having elongation of 400 to 1200% was provided on the surface of the developer carrying member 11, the fine powder of the developer 2 was hardly welded on the surface of the developer carrying member 11, so that the non-uniformity in density of an image after printing resistance was restrained, as compared with each of the developing devices in the comparative examples 5 and 6 in which the surface layer 11*a* whose rubber hardness and elongation do not satisfy the above-mentioned conditions was provided.

Furthermore, in each of the developing devices in the examples 10 to 13 and the comparative examples 5 and 6 in which the nitrogen-containing elastomer composed of polyamide was contained in the elastic material composing the surface layer 11*a* of the developer carrying member 11, the developer 2 was easily subjected to triboelectric charging even under a high temperature and a high humidity irrespective of the fact that no charge-controlling agent was added to the surface layer 11*a* of the developer carrying member 11 as described above, and the image was hardly fogged, as compared with the developing device in the example 14 in which no nitrogen-containing elastomer composed of polyamide was contained in the elastic material.

Particularly in the developing devices in the examples 10 to 12 and the comparative examples 5 and 6 using the Experimental Example 5

In the experimental example, an example of the developing roller 11 was a roller 11*c* made of a metal, an example of the controlling member 16 was one composed of an SUS plate, and an example of the developer 2 was the following toner B to F.

As in the developing device according to the above-mentioned embodiment 4, the surface layers 11*a* and 16*a* composed of the elastic material were respectively provided on parts of the surface of the developing roller 11 and the surface of the controlling member 16, to change the type of the surface layers 11*a* and 16*a*.

EXAMPLE 15

As the developer 2, the following toner B was used.

A reflex condenser, a water separator, a nitrogen gas inlet tube, an agitator, and a thermometer were attached to a 5 liter four neck flask, and the flask was set in a mantle heater. 1400 g of a compound obtained by adding 2 moles of ethylene oxide to bisphenol A, 90 g of diethylene glycol, and 996 g of isophthalic acid were added, and nitrogen was introduced into the flask. They were subjected to dehydrogenation condensation at a temperature of 230° C. while being agitated. The flask was gradually evacuated at the time point where the acid value or the hydroxyl value reached a predetermined value, followed by reaction at a temperature of 240° C. and at a pressure of 5 mmHg for one hour, to finally obtain polyester resin. With respect to the polyester resin, the acid value thereof was 45 KOHmg/g, the hydroxyl value thereof was 2 KOHmg/g, the number-average molecular weight Mn thereof was 2800, the glass transition point Tg thereof was 65° C., and the softening point Tm thereof was 103° C.

100 parts by weight of the above-mentioned polyester resin, 4 parts by weight of a phthalocyanine pigment which is a colorant, and 3.5 parts by weight of a charge-controlling agent (Bontron E-81: made by Orient Kagaku K. K.) were mixed at a speed of rotation of 2800 rpm by Henschel Mixer for three minutes, after which a mixture obtained was kneaded using a biaxial kneading extruder, and the kneaded mixture obtained was cooled, and was then coarsely pulverized.

Coarse powder obtained by the coarse pulverization was finely pulverized by the above-mentioned Cryptron grinding machine (KTM-1: manufactured by Kawasaki Heavy Industries, Ltd.). The above-mentioned grindability index K at this time was 0.7.

The coarse powder thus finely pulverized was classified by Elbow Jet (manufactured by Matusaka Boeki K. K.), to obtain toner particles having a volume-average particle diameter of 9.0 μm and containing 10.3% by number particles having a particle diameter of not more than 5 μm. Hydrophobic silica (Cabozil TS-500: made by Cabot K. K.) was added in the ratio of 1.0% by weight to the toner particles. They were mixed at a speed of rotation of 2500 rpm by Henschel Mixer for 90 seconds, to produce negatively charged toner B.

The surface layer 11*a* on the surface of the developing roller 11 and the surface layer 16*a* on the surface of the controlling member 16 were provided in the same manner as that in the example 5.

EXAMPLE 16

As the developer 2, the following toner C was used.

A reflux condenser, a water separator, a nitrogen gas inlet tube, an agitator, and a thermometer were attached to a 5 liter four neck flask, and the flask was set in a mantle heater. 1600 g of a compound obtained by adding 2 moles of ethylene oxide to bisphenol A and 840 g of isophthalic acid were introduced into the flask, and nitrogen was introduced into the flask. They were subjected to dehydrogenation condensation at a temperature of 230° C. while being agitated, and the flask was gradually evacuated at the time point where the acid value or the hydroxyl value reached a predetermined value, followed by reaction at a temperature of 240° C. and at a pressure of 5 mmHg for one hour, to finally obtain polyester resin. With respect to the polyester resin, the acid value thereof was 28 KOHmg/g, the hydroxyl value thereof was 1 KOHmg/g, the number-average molecular weight Mn thereof was 340, the glass transition point Tg thereof was 68° C., and the softening point Tm thereof was 108° C.

Negatively charged toner C was produced similarly to the above-mentioned toner B except that 100 parts by weight of the above-mentioned polyester resin, 4 parts by weight of a benzidine yellow pigment which is a colorant, and 3.5 parts by weight of a charge-controlling agent (Bontron E-84: made by Orient Kagaku K. K.) were used. The grindability index K of the toner was 1.0, the volume-average particle diameter thereof was 8.8 μm, and the content of particles having a particle diameter of not more than 5 μm was 10.9% by number of the toner.

The surface layer 11*a* on the surface of the developing roller 11 and the surface layer 16*a* on the surface of the controlling member 16 were provided in the same manner as that in the example 6.

EXAMPLE 17

As the developer 2, the following toner D was used.

Negatively charged toner D was produced similarly to the above-mentioned toner B except that 100 parts by weight of polyester resin having an acid value of 2 KOHmg/g, having a number-average molecular weight Mn of 8800, having a glass transition point Tg of 63° C., and having a softening point Tm of 131° C. (FB-1237: made by Mitubishi Rayon Co., Ltd.), 4 parts by weight of a quinacridone red pigment which is a colorant, 3.5 parts by weight of a charge-controlling agent (Bontron E-84: made by Orient Kagaku K. K.), and 1.5 parts by weight of a release agent (Carnauba Wax: made by Kato Yoko K. K.) were used. The grindability index K of the toner was 1.8, the volume-average particle diameter thereof was 9.7 μm, and the content of particles having a particle diameter of not more than 5 μm was 9.5% by number of the toner.

The surface layer 11*a* on the surface of the developing roller 11 and the surface layer 16*a* on the surface of the controlling member 16 were provided in the same manner as that in the example 15.

EXAMPLE 18

As the developer 2, the following toner E was used.

A reflux condenser, a water separator, a nitrogen gas inlet tube, an agitator, and a thermometer were attached to a 5 liter four neck flask, and the flask was set in a mantle heater. 1500 g of a compound obtained by adding 2 moles of ethylene oxide to bisphenol A and 850 g of isophthalic acid were introduced into the flask, and nitrogen was introduced into the flask. They were subjected to dehydrogenation condensation at a temperature of 230° C. while being agitated, and the flask was gradually evacuated at the time point where the acid value or the hydroxyl value reached a predetermined value, followed by reaction at a temperature of 240° C. and at a pressure of 5 mmHg for one hour, to finally obtain polyester resin. With respect to the polyester resin, the acid value thereof was 42 KOHmg/g, the hydroxyl value thereof was 3 KOHmg/g, the number-average molecular weight Mn thereof was 1800, the glass transition point Tg thereof was 45° C., and the softening point Tm thereof was 95° C.

Negatively charged toner E was produced similarly to the above-mentioned toner B except that 100 parts by weight of the above-mentioned polyester resin, 4 parts by weight of a benzidine yellow pigment which is a colorant, and 3.5 parts by weight of a charge-controlling agent (Bontron E-84: made by Orient Kagaku K. K.) were used. The grindability index K of the toner was 0.6, the volume-average particle diameter thereof was 9.0 μm, and the content of particles having a particle diameter of not more than 5 μm was 15.8% by number of the toner.

The surface layer 11*a* on the surface of the developing roller 11 and the surface layer 16*a* on the surface of the controlling member 16 were provided in the same manner as that in the example 15.

EXAMPLE 19

The same toner B as that in the example 15 was used as the developer 2, and the surface layer 11*a* was provided on the surface of the developer carrying member 11 in the same manner as that in the example 15.

On the other hand, the surface layer 16*a* was provided on the surface of the controlling member 16 in the same manner as that in the example 15 after 100 parts by weight of a thermoplastic polyamide elastomer and 7 parts by weight of carbon black (Furnace Black) were used. The rubber hardness and the elongation of the surface layer 16*a* were shown in Table 4.

EXAMPLE 20

The same toner C as that in the example 16 was used as the developer 2, and the surface layer 16*a* was provided on the surface of the controlling member 16 in the same manner as that in the example 16.

On the other hand, 100 parts by weight of a thermoplastic olefin elastomer and 45 parts by weight of carbon black (Acetylene Black) were kneaded and dispersed by three rolls, and the surface of the developer carrying member 11 was coated with a kneaded mixture obtained, after which the surface was polished, to form the surface layer 11*a*. The rubber hardness and the elongation of the surface layer 11*a* were shown in Table 4.

EXAMPLE 21

As the developer 2, the following toner F was used.

distribution was examined in the same manner as that in the cracking test 2 of the developer. The results were shown in the following Table 4.

Printing Resistance Test 4

The non-uniformity in density of an image after a printing resistance test of 20,000 sheets was examined and evaluated in the same manner as that in the printing resistance test 1 except that the image was formed at a system speed of 150 mm/s.

OHP Light Transmission

The toner was supplied using each of the developing devices, to form a toner image on sheets for OHP, after which a toner image was fixed by a fuser coated with silicone oil at a temperature of 160° C. The obtained image was visually evaluated. A case where good color reproducibility was obtained was indicated by ○, a case where the color was slightly muddy, which practically presents no problem was indicated by Δ, and a case where there was no light transmission, which presents a problem was indicated by X.

TABLE 4

| | Surface layer | | | | | | | | | printing | |
|---|---|---|---|---|---|---|---|---|---|---|---|
| | developing roller | | | controlling member | | | | cracking test (number %) | | resistance test | |
| example | hardness (°) | elongation % | resistance value (Ω · cm) | hardness (°) | elongation % | resistance value (Ω · cm) | grindability index K of developer | initial stages | after rotating 250 times | non-uniformity in density | OHP light transmission |
| 15 | 62 | 658 | $2.6 \times 10^7$ | 52 | 820 | $7.4 \times 10^7$ | 0.7 | 10.3 | 16.7 | Δ | ○ |
| 16 | 66 | 486 | $4.1 \times 10^6$ | 69 | 760 | $2.1 \times 10^9$ | 1.0 | 10.9 | 14.2 | ○ | ○ |
| 17 | 62 | 658 | $2.6 \times 10^7$ | 52 | 820 | $7.4 \times 10^7$ | 1.8 | 9.5 | 10.8 | ○ | Δ |
| 18 | 62 | 658 | $2.6 \times 10^7$ | 52 | 820 | $7.4 \times 10^7$ | 0.6 | 15.8 | 25.1 | X | ○ |
| 19 | 62 | 658 | $2.6 \times 10^7$ | 93 | 250 | $4.3 \times 10^7$ | 0.7 | 10.3 | 24.6 | X | ○ |
| 20 | 87 | 440 | $1.5 \times 10^5$ | 69 | 760 | $3.3 \times 10^{10}$ | 1.0 | 10.9 | 22.2 | X | Δ |
| 21 | 62 | 658 | $2.6 \times 10^7$ | 52 | 820 | $7.4 \times 10^7$ | 2.1 | 9.0 | 10.4 | ○ | X |

Negatively charged toner F was produced similarly to the above-mentioned toner B except that 100 parts by weight of polyester resin (Byron 200: made by Toyobo Co., Ltd.) having a number-average molecular weight Mn of 16800, having a glass transition point $T_g$ of 69° C., and having a softening point Tm of 153° C., 4 parts by weight of a benzidine yellow pigment which is a colorant, and 3.5 parts by weight of a charge-controlling agent (Bontron E-84: made by Orient Kagaku K. K.) were used. The grindability index K of the toner was 2.1, the volume-average particle diameter thereof was 10.0 μm, and the content of particles having a particle diameter of not more than 5 μm was 9.0% by number of the toner.

The surface layer 11*a* on the surface of the developing roller 11 and the surface layer 16*a* on the surface of the controlling member 16 were provided in the same manner as that in the example 15.

In each of the developing devices shown in the above-mentioned examples 15 to 21, a cracking test of the developer was carried out, and non-uniformity in density after a printing resistance test of 20,000 sheets and OHP light transmission on a color image were evaluated. The results were together shown in the following Table 4.

Cracking Test 3 of Developer

The ratio (number %) of fine power components having a particle diameter of not more than 5 μm in the number As a result, in each of the developing devices in the examples 15 to 17 in which the surface layer 11*a* of the developer carrying member 11 and the surface layer 16*a* of the controlling member 16 pressed against the surface of the developer carrying member 11 were composed of an elastic material having a rubber hardness in the range of 20° to 70° and having elongation in the range of 400 to 1200%, and the toner having a grindability index K in the range of 0.7 to 2.0 was used, the increase of the fine power components in the cracking test was slight, so that the occurrence of the non-uniformity in density of the formed image was restrained, and an image which is superior for OHP was stably obtained.

Furthermore, as in the developing device in the example 18, when the toner having a low grindability index K was used, the toner was cracked, producing a lot of fine power components, so that the formed image was made highly non-uniform in density. As in the developing devices in the examples 19 and 20, even when the rubber hardness was increased on either one of the surface layer 11*a* of the developer carrying member 11 and the surface layer 16*a* of the controlling member 16, the toner was easily cracked, producing a lot of fine power components, so that the formed image was made highly non-uniform in density.

As in the developing device in the example 21, when the toner having a high grindability index K was used, the fine power components were prevented from being increased by the cracking of the toner. When a toner image was formed on sheets for OHP as described above, after which the toner image was fixed by the fuser coated with silicone oil at low temperature, however, the toner was not sufficiently welded, so that the fixing properties were degraded, and an image having sufficient light transmission was not obtained.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. A developing device comprising:

a developer carrying member holding a developer on its surface and conveying the developer to a developing area opposite to an image carrying member, the developer carrying member having a surface layer composed of an elastic material having a rubber hardness of 20° to 70° and having elongation of 420 to 1200%; and a controlling member arranged with its part pressed against the surface layer of said developer carrying member for controlling an amount of the developer conveyed to the developing area by said developer carrying member.

2. The developing device according to claim 1, wherein the rubber hardness of said elastic material is 30° to 70°, and the elongation thereof is 420 to 950%.

3. The developing device according to claim 1, wherein a specific volume resistance value of said surface layer is $1\times10^{3}$~$1\times10^{15}$ Ω·cm.

4. The developing device according to claim 1, wherein a thickness of said surface layer is not less than 100 μm.

5. The developing device according to claim 1, wherein said surface layer contains a charge-controlling agent, a charging polarity of the charge-controlling agent being opposite to a charging polarity of said developer.

6. The developing device according to claim 1, wherein said surface layer contains conductive fine particles.

7. The developing device according to claim 1, wherein said developer carrying member is a non-magnetic developer carrying member comprising no magnet member.

8. A developing device comprising:

a developer carrying member holding a developer on its surface and conveying the developer to a developing area opposite to an image member, the developer carrying member having a surface layer composed of an elastic material having a rubber hardness 20° to 70° and having elongation of 400 to 1200%, said elastic material containing a nitrogen-containing elastomer; and a controlling member arranged with its part pressed against the surface layer of said developer carrying member for controlling an amount of the developer conveyed to the developing area by said developer carrying member.

9. A developing device comprising:

a developer carrying member holding a developer on its surface and conveying the developer to a developing area opposite to an image carrying member, the developer carrying member having a surface layer composed of an elastic material having a rubber hardness of 20° to 70° and having elongation of 400 to 1200%; and a controlling member arranged with its-part pressed against the surface layer of said developer carrying member for controlling an amount of the developer conveyed to the developing area by said developer carrying member, wherein said developer is a monocomponent developer having a volume-average particle diameter of 5 to 12 μm, and containing not more than 20% by number particles having a particle diameter of not more than 5 μm.

10. The developing device according to claim 9, wherein said developer contains binder resin and a colorant, a number-average molecular weight of the binder resin being 1000 to 15000, a softening point thereof being 80° to 160° C., and a glass transition point thereof being 50 to 75° C.

11. The developing device according to claim 9, wherein the rubber hardness of said elastic material is 30° to 70°, and the elongation thereof is 420 to 1200%.

12. The developing device according to claim 9, wherein said developer has the volume-average particle diameter of 7 to 10 μm, and contains not more than 15% by number particles having a particle diameter of not more than 5 μm.

13. A developing device comprising:

a developer carrying member holding a developer on its surface and conveying the developer to a developing area opposite to an image carrying member; and a controlling member arranged with its part pressed against the surface of said developer carrying member for controlling an amount of the developer conveyed to the developing area by said developer carrying member, the controlling member having a surface layer pressed against the developer carrying member, and the surface layer composed of an elastic material having a rubber hardness of 20° to 70° and having elongation of 400 to 1200%.

14. The developing device according to claim 13, wherein the rubber hardness of said elastic material is 40° to 70°, and the elongation thereof is 550 to 1200%.

15. The developing device according to claim 13, wherein a specific volume resistance value of said surface layer is $1\times10^{3}$~$1\times10^{15}$ Ω·cm.

16. The developing device according to claim 13, wherein a thickness of said surface layer is not less than 100 μm.

17. The developing device according to claim 13, wherein said surface layer contains a charge-controlling agent, a charging polarity of the charge-controlling agent being opposite to a charging polarity of said developer.

18. The developing device according to claim 13, wherein said surface layer contains conductive fine particles.

19. The developing device according to claim 13, wherein said controlling member is a blade, its one end being fixedly arranged on the developing device, and the other end being a free end.

20. The developing device according to claim 19, wherein said free end is arranged on the upstream side in the direction of movement of said developer carrying member.

21. A developing device comprising:

a developer carrying member holding a developer on its surface and conveying the developer to a developing area opposite to an image carrying member; and a controlling member arranged with its part pressed against the surface of said developer carrying member for controlling an amount of the developer conveyed to the developing area by said developer carrying member, the controlling member having a surface layer composed of an elastic material having a rubber hardness of 20° to 70° and having elongation of 400 to 1200%, said elastic material containing a thermoplastic elastomer that is a nitrogen-containing elastomer.

22. A developing device comprising:

a developer carrying member holding a developer on its surface and conveying the developer to a developing a opposite to an image carrying member; and a controlling member arranged with its part pressed against the surface of said developer carrying member for controlling an amount of the developer conveyed to the developing area by said developer carrying member, the controlling member having a surface layer composed of an elastic material having a rubber hardness of 20° to 70° and having elongation of 400 to 1200%, wherein said developer is a monocomponent developer having a volume-average particle diameter of 5 to 12 μm, and containing not more than 20% by number particles having a particle diameter of not more than 5 μm.

23. The developing device according to claim 22, wherein said developer has the volume-average particle diameter of 7 to 10 μm, and contains not more than 15% by number particles having a particle diameter of not more than 5 μm.

24. A developing device comprising:

a developer carrying member holding a developer on its surface and conveying the developer to a developing area opposite to an image carrying member, the developer carrying member having a first surface layer composed of an elastic material having a rubber hardness of 20° to 70° and having elongation of 420 to 1200%; and a controlling member arranged with its part pressed against the first surface layer of said developer carrying member for controlling an amount of the developer conveyed to the developing area by said developer carrying member, the controlling member having a second surface layer pressed against the first surface layer of the developer carrying member, and the second surface layer composed of an elastic material having a rubber hardness of 20° to 70° and having elongation of 400 to 1200%.

25. The developing device according to claim 24, wherein the rubber hardness of the elastic material in said first surface layer is 30° to 70°, and the elongation thereof is 420 to 950%, and the rubber hardness of the elastic material in said second surface layer is 40° to 70°, and the elongation thereof is 550 to 1200%.

26. The developing device according to claim 24, wherein a specific volume resistance values of said first and second surface layers are $1\times10^{3}$~$1\times10^{15}$ Ω·cm.

27. The developing device according to claim 24, wherein a thickness of said first and second surface layers are not less than 100 μm.

28. The developing device according to claim 24, wherein a thermoplastic elastomer is contained as said elastic material in said second surface layer.

29. The developing device according to claim 24, wherein said first surface layer contains conductive fine particles.

30. The developing device according to claim 24, wherein said developer is a developer for full-color image formation.

31. The developing device according to claim 30, wherein a grindability index of said developer is 0.7 to 2.0.

32. The developing device according to claim 30, wherein said developer contains binder resin and a colorant, a number-average molecular weight of the binder resin being 2000 to 9000, a softening point thereof being 85° to 135° C., and a glass transition point thereof being 55° to 75° C.

33. The developing device according to claim 32, wherein the number-average molecular weight of said binder resin is 2500 to 6000, the softening point thereof is 90° to 120° C., and the glass transition point thereof is 58° to 70° C.

34. A developing device comprising:

a developer carrying member holding a developer on its surface and conveying the developer to a developing area opposite to an image carrying member, the developer carrying member having a first surface composed of an elastic material having a rubber hardness of 20° to 70° and having elongation of 400 to 1200%; and a controlling member arranged with its part pressed against the first surface layer of said developer carrying member for controlling developer an amount conveyed to the developing area by said developer carrying member, the controlling member having a second layer composed of an elastic material having a rubber hardness of 20° to 70° and having elongation of 400 to 1200%, wherein said developer is a monocomponent developer having a volume-average particle diameter of 5 to 12 μm, and containing not more than 20% by number particles having a particle diameter of not more than 5 μm.

35. The developing device according to claim 34, wherein the rubber hardness of the elastic material in said first surface layer is 30° to 70°, and the elongation thereof is 420 to 1200%.

36. The developing device according to claim 34, wherein said developer has the volume-average particle diameter of 7 to 10 μm, and contains not more than 15% by number particles having a particle diameter of not more than 5 μm.

* * * * *

UNITED STATES PATENT AND TRADEMARK OFFICE

CERTIFICATE OF CORRECTION

PATENT NO. : 5,875,379

DATED : February 23, 1999

INVENTOR(S) : MACHIDA et al.

It is certified that error appears in the above-identified patent and that said Letters Patent is hereby corrected as shown below:

Title page, item [75],
Under "Inventors": Change "Syuichi" to --Shuichi--.

Signed and Sealed this

Thirtieth Day of November, 1999

*Attest:*

*Attesting Officer*

Q. TODD DICKINSON

*Acting Commissioner of Patents and Trademarks*